US011491537B2

(12) United States Patent
Tsukaguchi

(10) Patent No.: US 11,491,537 B2
(45) Date of Patent: Nov. 8, 2022

(54) SLIDING GATE

(71) Applicant: NIPPON STEEL CORPORATION, Tokyo (JP)

(72) Inventor: Yuichi Tsukaguchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/976,370

(22) PCT Filed: Apr. 10, 2019

(86) PCT No.: PCT/JP2019/015592
§ 371 (c)(1),
(2) Date: Aug. 27, 2020

(87) PCT Pub. No.: WO2019/198745
PCT Pub. Date: Oct. 17, 2019

(65) Prior Publication Data

US 2021/0046542 A1 Feb. 18, 2021

(30) Foreign Application Priority Data

Apr. 11, 2018 (JP) ..... JP2018-075947

(51) Int. Cl.
*B22D 41/24* (2006.01)
*B22D 11/18* (2006.01)

(52) U.S. Cl.
CPC ..... *B22D 41/24* (2013.01); *B22D 11/18* (2013.01)

(58) Field of Classification Search
CPC ..... B22D 41/24; B22D 11/18
USPC ..... 222/600
See application file for complete search history.

(56) References Cited

U.S. PATENT DOCUMENTS 3,912,134 A * 10/1975 Poran ..... B22D 41/26 222/600
5,518,154 A * 5/1996 Vassilicos ..... B22D 41/24 222/600
2019/0337050 A1* 11/2019 Fukunaga ..... B22D 41/28

FOREIGN PATENT DOCUMENTS

| | | | |
|---|---|---|---|
| JP | 59-20958 | U | 2/1984 |
| JP | 7-303949 | A | 11/1995 |
| JP | 2000-237852 | A | 9/2000 |
| JP | 3615437 | B2 | 2/2005 |
| JP | 2006-346688 | A | 12/2006 |

* cited by examiner

*Primary Examiner* — Scott R Kastler
(74) *Attorney, Agent, or Firm* — Birch, Stewart, Kolasch & Birch, LLP

(57) ABSTRACT

In a sliding gate, a flow path vertical angle a between a flow path axial direction and a vertical downstream direction in a flow path hole in each plate is 5° or more and 75° or less, and a flow path axial direction projected on sliding surface in which the flow path axial direction is projected on a sliding surface differs between the plates and is changed clockwise or counterclockwise toward a downstream side. Then, molten metal forms a turning flow in the flow path hole of the sliding gate. Furthermore, the molten metal also forms a turning flow in a ladle shroud on the downstream side of the sliding gate.

2 Claims, 11 Drawing Sheets

COMPARATIVE EXAMPLE

COMPARATIVE EXAMPLE

COMPARATIVE EXAMPLE

SLIDING GATE

TECHNICAL FIELD OF THE INVENTION

The present invention relates to a sliding gate for adjusting a flow rate of molten metal in a process of injecting the molten metal from a ladle to a tundish or from a tundish to a mold in continuous casting of the molten metal such as steel. Specifically, the present invention relates to a method for turning a molten metal flow using a sliding gate.

Priority is claimed on Japanese Patent Application No. 2018-075947, filed Apr. 11, 2018, the content of which is incorporated herein by reference.

RELATED ART

In continuous casting of molten metal such as steel, as illustrated in FIG. 1, molten metal 21 is injected from a ladle 14 into a tundish 15, and the molten metal 21 is injected from the tundish 15 into a mold 16. In each process of injecting the molten metal 21, a sliding gate 1 is used to adjust a flow rate of the molten metal 21. In general, the sliding gate 1 includes two or three plates 2, and each of the plates 2 includes a flow path hole 6 through which the molten metal 21 passes. FIGS. 10 and 11 illustrate a case where the sliding gate 1 includes three plates. One of the three plates slidable between contacting plates is provided so as to be movable along a sliding surface 30 and is referred to as a slide plate 4. The remaining two plates 2 do not move with respect to the ladle 14 or the tundish 15 to which the sliding gate 1 is attached and are referred to as fixed plates (upper fixed plate 3 and lower fixed plate 5). An opening area of an opening part which is the overlapping part of the flow path holes 6 between the adjacent plates 2 (fixed plates) is adjusted by sliding the slide plate 4. Accordingly, it is possible to adjust a flow rate of the molten metal 21, and it is possible to open or close the sliding gate 1. FIG. 10 illustrates a case where the opening part is fully open, and FIG. 11 illustrates a case where the opening part is 1/2 open.

A ladle shroud 11 such as a long nozzle 12 is provided below the sliding gate 1 provided in a bottom part of the ladle 14. When the molten metal 21 flowing out from the sliding gate 1 of the ladle 14 is injected into the tundish 15, the molten metal 21 is guided into the tundish 15 via a flow path inside the ladle shroud 11. In addition, a ladle shroud 11 such as an immersion nozzle 13 is provided below the sliding gate 1 provided in a bottom part of the tundish 15. When the molten metal 21 flowing out from the sliding gate 1 of the tundish 15 is injected into the mold 16, the molten metal 21 is guided into the mold 16 via a flow path inside the ladle shroud 11.

The molten metal 21 flowing out from the sliding gate 1 of the bottom part of the ladle 14 already has a flow velocity toward a downstream side when passing through the sliding gate 1, and in a process in which the molten metal 21 falls through the ladle shroud 11, the flow velocity of the molten metal 21 further increases. The molten metal 21 poured into the tundish 15 forms a flow which passes through the bottom part of the tundish 15 at a high speed, and an opportunity for sufficiently floating and separating a nonmetallic inclusion contained in the molten metal 21 in the tundish 15 cannot be obtained. Accordingly, the nonmetallic inclusion directly flows into the mold 16 together with the molten metal 21, which causes deterioration of quality of a slab.

When the flow of the molten metal 21 is turned in the ladle shroud 11, a portion of kinetic energy of the viscously flowing molten metal 21 is distributed to a turning flow velocity, and the flow velocity of the molten metal 21 flowing downward can be reduced. Accordingly, it is known that a maximum flow velocity of the downward flow discharged from the ladle shroud 11 into the tundish 15 decreases, and disturbance of the viscous flow in the tundish 15 due to the discharge flow can be suppressed. For example, Patent Document 1 discloses a method of providing a turning provision mechanism in a long nozzle used for injection from a ladle to a tundish.

It is known that when the molten metal 21 is injected into the mold 16 from the ladle shroud 11 such as the immersion nozzle 13 through the sliding gate 1 in the bottom part of the tundish 15, the nonmetallic inclusion adheres to the flow path inside the immersion nozzle 13. Patent Document 2 discloses a method of, in order to reduce nozzle narrowing and blockage of a flow path in an immersion nozzle, providing a turning flow into the immersion nozzle by devising a shape of an intermediate nozzle in a process of injecting molten metal from a tundish to a mold.

Moreover, Patent Document 3 discloses a method of providing a turning provision mechanism (blade) inside an immersion nozzle used for injection from a tundish into a mold. Further, Patent Document 4 discloses a method of providing a notch in a flow path of a sliding gate to turn molten steel.

PRIOR ART DOCUMENT

Patent Document

[Patent Document 1] Japanese Unexamined Patent Application, First Publication No. 2006-346688

[Patent Document 2] Japanese Unexamined Patent Application, First Publication No. H07-303949

[Patent Document 3] Japanese Unexamined Patent Application, First Publication No. 2000-237852

[Patent Document 4] Japanese Patent No. 3615437

DISCLOSURE OF THE INVENTION

Problems to be Solved by the Invention

The methods of Patent Document 1 and Patent Document 4 provide limited turning to a flow near a wall surface. Accordingly, there is problem that the obtained turning is weak, or a groove or notch is melted and a turning effect cannot be maintained.

In the method of Patent Document 2, there is a problem that a shape of a mechanism for providing the turning is complicated and manufacturing thereof is difficult.

In the method of Patent Document 3, there is a problem that the turning provision mechanism in the immersion nozzle and a periphery thereof are likely to be closed by the nonmetallic inclusion.

The present invention solves the problems of the related art, and an object thereof is to provide a sliding gate capable of providing a turning flow having sufficient strength in a ladle shroud for injecting molten metal by a compact and simple mechanism without increasing a risk of blockage of a flow path, by devising a structure of a sliding gate disposed above the ladle shroud.

Means for Solving the Problem

The present invention is made in consideration of the above circumstances and employs embodiments described below. Moreover, in the present invention, a ladle shroud such as a long nozzle for injecting molten steel from a ladle to a tundish, and a ladle shroud such as an immersion nozzle for injecting molten metal from the tundish into a mold are collectively referred to simply as a "ladle shroud".

The present inventor conducted repeated studies and experiments on a method for solving the problems of the prior art in order to reduce a flow velocity in a downstream direction by applying a turning flow velocity to the molten metal flowing down through a flow path in the ladle shroud. In this case, from the viewpoint of preventing blockage of the flow path, insertion of a structure such as a blade bisecting the flow path was avoided. Then, among a portion constituting the existing flow path including the ladle shroud and the sliding gate disposed above the ladle shroud, the present inventor focused on the sliding gate sharply narrowing the flow path to provide a violent flow and devised a shape of the sliding gate to apply turning to a molten metal flow in the ladle shroud.

The first reason is that a turning provision mechanism can be configured to be compact by targeting a small cross section and a high-speed flow narrowed in the sliding gate. The second reason is that if an attempt is made to provide a circumferential flow velocity to a descending flow in the flow path of the ladle shroud, the viscous flow in the ladle shroud is disturbed, which may cause damage to a refractory material of the ladle shroud and promote adhesion of non-metallic inclusions. In addition, there is little risk of a new disturbance occurring in the sliding gate where a violent flow originally occurs. Further, by combining oblique holes formed in a plurality of plates of the sliding gate in different directions, it is possible to realize a complicated flow path structure which is difficult to form with one member.

The present invention has been devised from this viewpoint and obtains a turning flow by devising a shape of a flow path hole formed in the plate of the sliding gate. In the present invention, it has been noted that a cross-sectional shape of each flow path is not complicated so as not to cause flow path blockage or flow path wall erosion.

That is, the gist of the present invention is as follows.

(1) According to a first aspect of the present invention, a sliding gate is provided which includes a plurality of plates having a flow path hole through which molten metal passes, at least one of the plurality of plates being a slidable slide plate, and is used for adjusting a flow rate of the molten metal, in which in the flow path hole in each of the plurality of plates, an upstream-side surface open hole is formed on an upstream-side surface of surfaces of the plate located on an upstream side of the molten metal passing through the flow path hole, and a downstream-side surface open hole is formed on a downstream-side surface located on a downstream side, when a direction from a centroid of a figure of the upstream-side surface open hole toward a centroid of a figure of the downstream-side surface open hole is defined as a flow path axial direction, a flow path vertical angle a between a vertical downstream direction which is a downstream direction perpendicular to sliding surfaces of the plurality of plates and the flow path axial direction is 5° or more and 75° or less, and when a direction in which the flow path axial direction is projected on the sliding surface is referred to as a flow path axial direction projected on sliding surface, a sliding direction of the slide plate when the sliding gate is closed is referred to as a sliding closing direction, an angle which is formed between the sliding closing direction and the flow path axial direction projected on sliding surface clockwise when viewed in the vertical downstream direction is referred to as a flow path horizontal angle θ which is within a range of±180°, the flow path horizontal angles θ being different between the plurality of plates adjacent to each other, the number of the plurality of plates is a total of N, where N is an integer of 1 or more, the flow path horizontal angles θ of the plurality of plates are sequentially set to $\theta_1, \theta_2, \ldots \theta_N$ from the plate on a most upstream side to an Nth plate, and an angle $\Delta\theta_n=\theta_N-\theta_{N+1}$ (n is an integer of 1 or more and up to the number of plates−1), the angles $\Delta\theta_n$ are each 10° or more and less than 170°, or all the angles $\Delta\theta_n$ are more than −170° and −10° or less.

(2) As a second aspect according to the sliding gate of the first aspect, the total number of the plurality of plates may be two or three, and the number of the slide plates may be one.

Effects of the Invention

According to the above aspect of the present invention, in the sliding gate used for adjusting the flow rate of the molten metal, the flow path vertical angle a between the flow path axial direction and the vertical downstream direction in the flow path hole in each plate is 5° or more and 75° or less, and the flow path axial direction projected on sliding surface in which the flow path axial direction is projected on the sliding surface differs between the plates and is changed clockwise or counterclockwise toward a downstream side. According to this configuration, the molten metal forms a turning flow in the flow path hole of the sliding gate. Further, the molten metal also forms a turning flow in the ladle shroud on the downstream side of the sliding gate. Accordingly, a maximum flow velocity in a downstream direction can be suppressed as compared with a sliding gate of the related art.

EMBODIMENTS OF THE INVENTION

Figure 1:
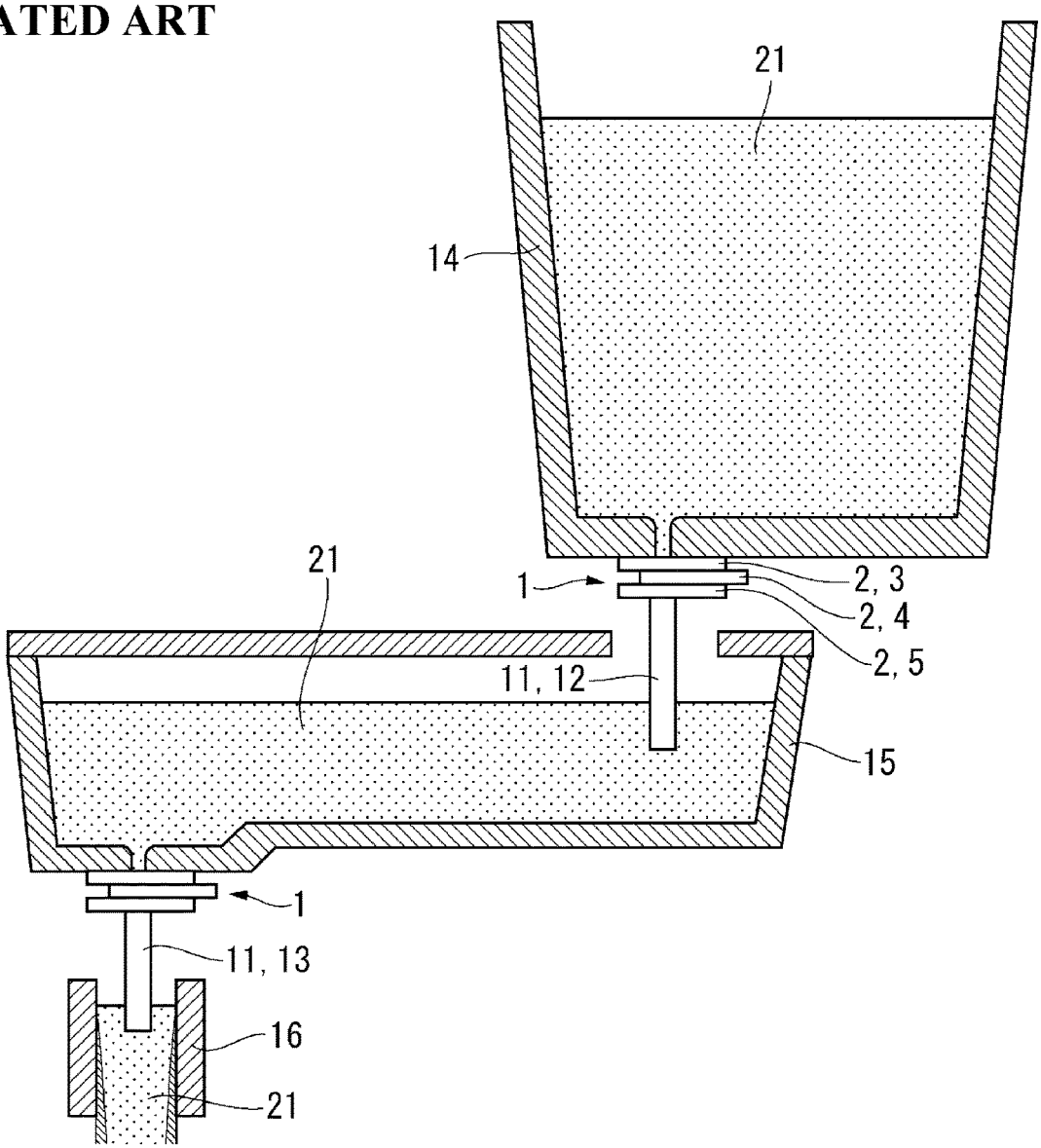
FIG. 1 RELATED ART
FIG. 1 is a conceptual longitudinal sectional view illustrating an example of a relationship between a ladle, a tundish, a mold, and a sliding gate of a continuous casting apparatus.

Embodiments of the present invention and modification examples thereof will be described with reference to FIGS. 1 to 11. Moreover, in the following descriptions, the same reference symbols are used to clearly explain a correspondence between the related art, the present embodiment, and a modification example thereof. However, even if the reference symbols are the same, descriptions related to FIGS. 10 and 11 illustrate the related art, and descriptions related to FIGS. 1 to 9 illustrate the embodiments of the present invention and the modification examples thereof.

In a process in which molten metal 21 is injected from a ladle 14 into a tundish 15 or from the tundish 15 into a mold 16 in continuous casting of molten metal such as steel, a sliding gate 1 is used for a purpose of adjusting a flow rate of the molten metal 21. In the sliding gate 1 configured by stacking two or three plates 2, each plate 2 includes a flow path hole 6. When a slide plate 4 of the plurality of plates constituting the sliding gate 1 slides and the sliding gate 1 is "open" due to overlapping between the flow path holes 6 of the respective plates 2, the molten metal 21 flows from an upstream side toward a downstream side of the flow path hole 6. A direction (hereinafter, referred to as a vertical downstream direction 32) perpendicular to a sliding surface 30 of the plate 2 and toward a downstream direction is generally vertically downward from top to bottom. In a case of horizontal continuous casting, the vertical downstream direction 32 faces a horizontal direction. In the following, basically, a case where the sliding surface 30 is horizontal and the vertical downstream direction 32 is vertically downward will be described as an example.

Figure 10:
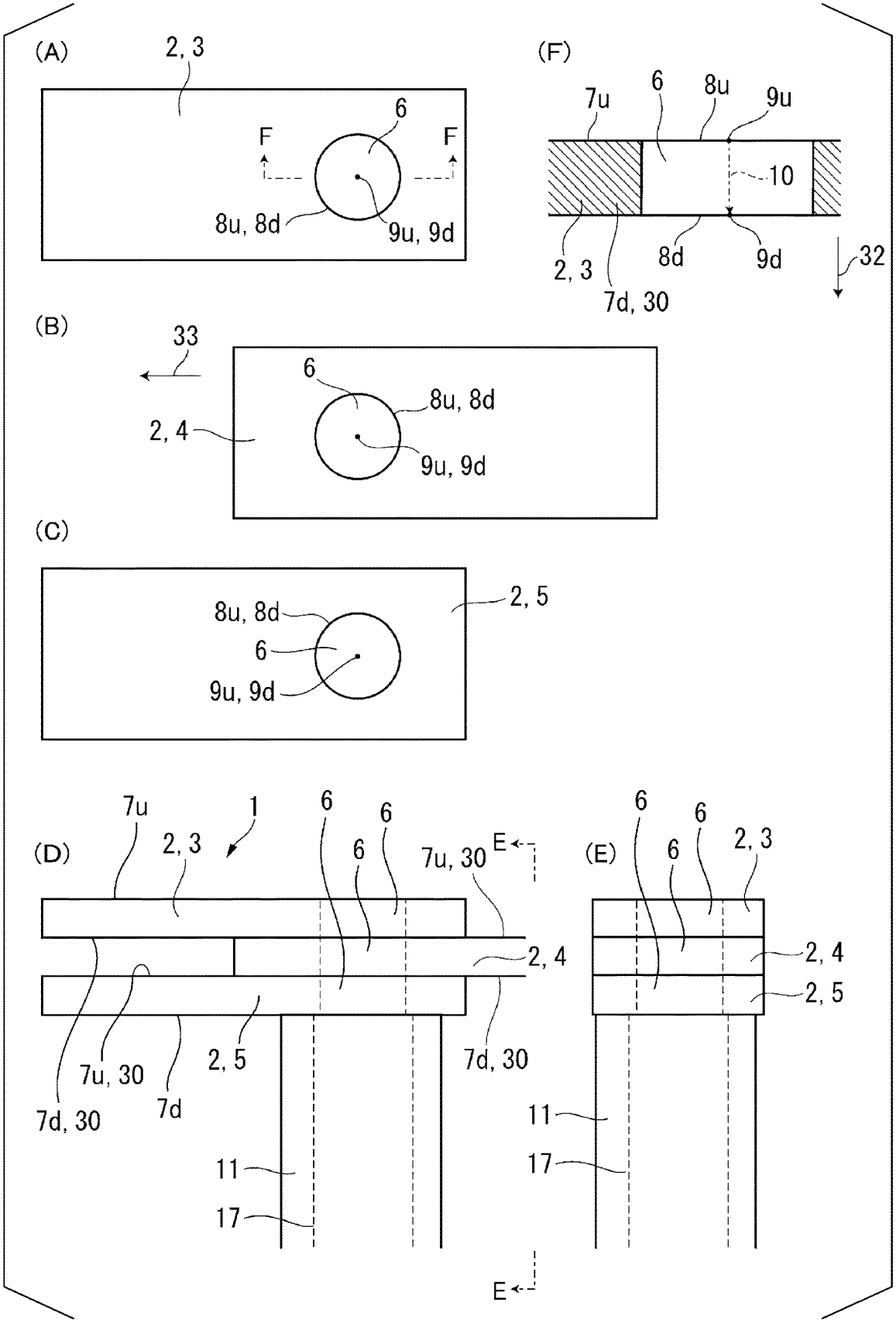
FIG. 10 RELATED ART
FIG. 10 is a view illustrating a sliding gate of the related art, (A) is a plan view of an upper fixed plate, (B) is a plan view of a slide plate, and (C) is a plan view of a lower fixed plate. (D) is a front view in which the sliding gate and a ladle shroud are combined with each other. (E) is a view taken along line E-E of (D), and (F) is a cross-sectional view taken along line F-F of (A).
Figure 11:
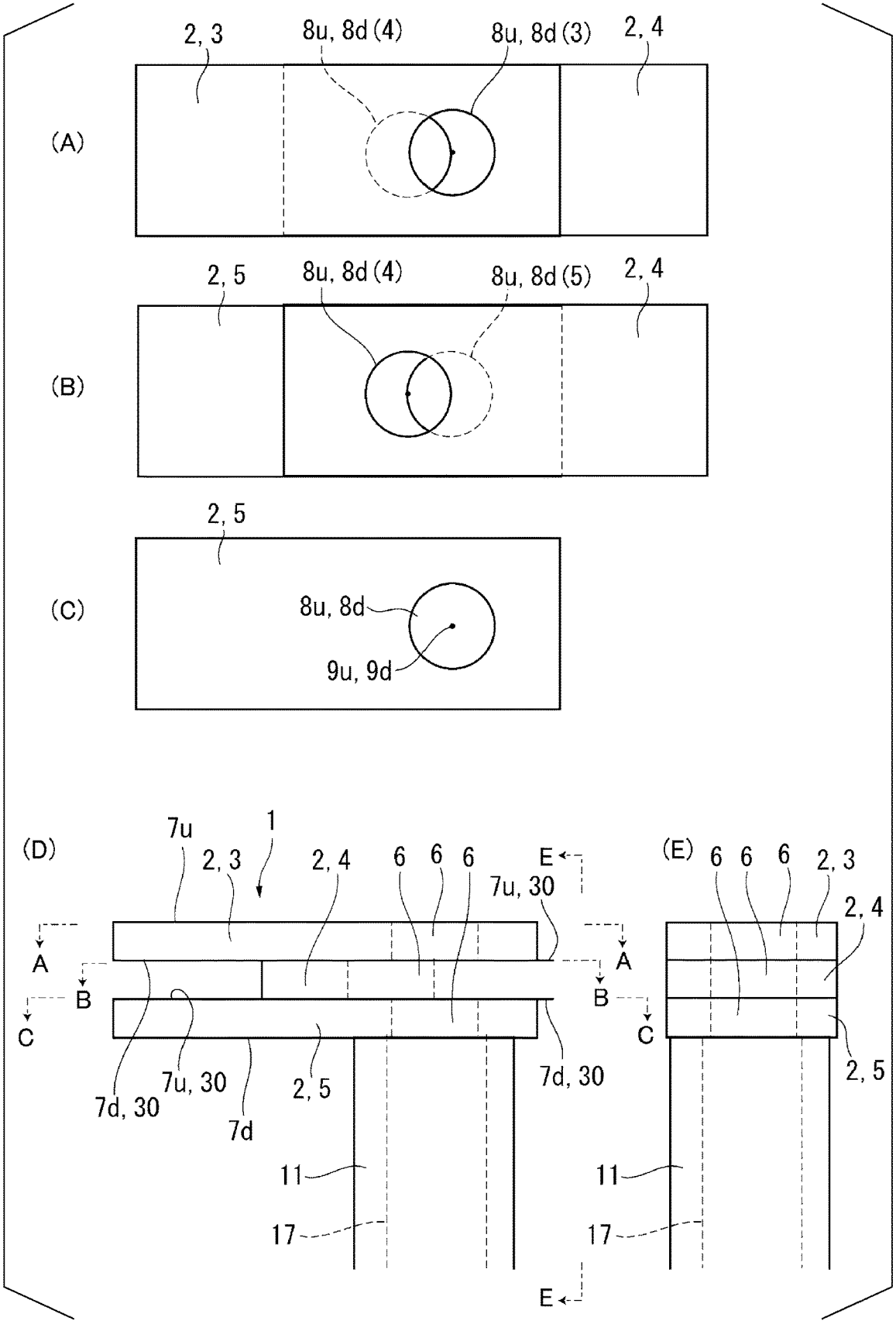
FIG. 11 RELATED ART
FIG. 11 is a view illustrating the sliding gate of the related art, (A) is a view taken along line A-A of (D), (B) is a view taken along line B-B of (D), (C) is a view taken along line C-C of (D), (D) is a front view in which the sliding gate and the ladle shroud are combined with each other, and (E) is a view taken along line E-E of (D).

In a case of a configuration of the related art, as illustrated in FIGS. 10 and 11, in general, a flow path hole 6 of a plate 2 has a cylindrical inner peripheral shape and an axial direction of the cylinder is parallel to a vertical downstream direction 32. In the present embodiment, as illustrated in FIGS. 2 to 9, a direction in which a center axis of the flow path hole 6 is directed is an oblique hole having a certain angle from the vertical downstream direction 32. Furthermore, in the present embodiment, directions of the oblique holes projected on the sliding surface 30 are appropriately combined with each other to be different from each other between two or three plates. According to this configuration, not only a flow toward the downstream side but also a circumferential flow velocity is added to a molten metal flow inside the sliding gate 1 and the ladle shroud 11 on a downstream side of the sliding gate 1 to form a turning flow.

As a cross-sectional shape of the flow path hole 6, in general, a cylindrical shape of which a cross section perpendicular to the axial direction is a perfect circle is used. In the sliding gate 1 of the present embodiment, the flow path hole 6 formed in the plate 2 is not limited to the cylindrical shape, and may be changed in the plate 2 in the axial direction of the flow path hole 6. Therefore, first, the axis of the flow path hole 6 formed in the plate 2 is defined.

Moreover, first, the flow path hole 6 of the sliding gate 1 of the related art will be described with reference to FIG. 10. The sliding gate 1 illustrated in FIG. 10 has three plates 2 and includes an upper fixed plate 3, a slide plate 4, and a lower fixed plate 5 from an upstream side. Each plate 2 has a flow path hole of which a cross section is a perfect circular cylindrical shape, and the flow path hole 6 is formed, in which an axial direction of a cylinder is directed in vertical downstream direction (hereinafter, referred to as a vertical downstream direction 32) with respect to a sliding surface 30. An upstream-side surface of each plate 2 is referred to as an upstream surface 7*u* and a downstream-side surface thereof is referred to as a downstream surface 7*d*. A figure (upstream-side surface open hole) formed by an inner circumferential surface of the flow path hole 6 on the upstream surface 7*u* is referred to as an upstream open hole 8*u*. Moreover, a figure (downstream-side surface open hole) formed by an inner circumferential surface of the flow path hole 6 on the downstream surface 7*d* is referred to as a downstream open hole 8*d*. In the example illustrated in FIG. 10, since an axis of a cylindrical shape of the flow path hole 6 is perpendicular to the sliding surface 30, the upstream open hole 8*u* and the downstream open hole 8*d* overlap each other in plan views illustrated in (A) to (C) of FIG. 10. If shapes of the upstream open hole 8*u* and the downstream open hole 8*d* are considered as figures, a centroid of each of the figures can be defined. The centroid of the figure of the upstream-side surface open hole is referred to as a centroid 9*u* of the upstream open hole, and the centroid of the figure of the downstream-side surface open hole is referred to as a centroid 9*d* of the downstream open hole. In the example illustrated in FIG. 10, since the figure shapes of both the upstream open hole 8*u* and the downstream open hole 8*d* are perfect circles, the centroid 9*u* of the upstream open hole and the centroid 9*d* of the downstream open hole coincide with a center of the perfect circle figure. Next, a direction which passes through the centroid 9*u* of the upstream open hole and the centroid 9*d* of the downstream open hole and is directed to the downstream side is defined as a flow path axial direction 10. In the example illustrated in FIG. 10, the flow path axial direction 10 is the same as the vertical downstream direction 32. In (F) of FIG. 10, a line drawn by a dashed line is the flow path axial direction 10.

Figure 2:
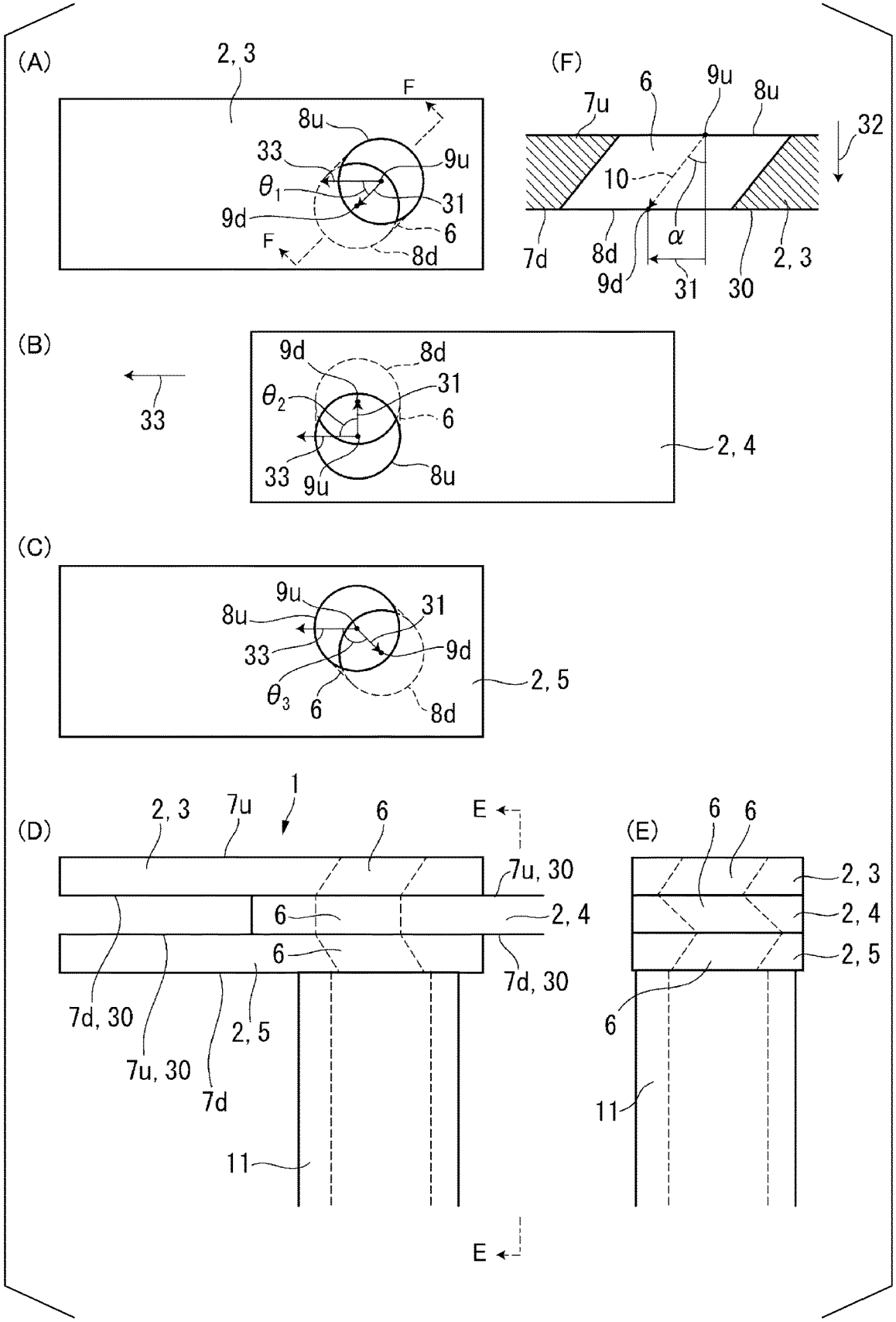
FIG. 2 is a diagram illustrating a sliding gate according to an embodiment of the present invention, (A) is a plan view of an upper fixed plate, (B) is a plan view of a slide plate, and (C) is a plan view of a lower fixed plate. (D) is a front view in which the sliding gate and a ladle shroud are combined with each other. (E) is a view taken along line E-E of (D), and (F) is a cross-sectional view taken along line F-F of (A).

Next, the flow path hole 6 of the sliding gate 1 of the present embodiment will be described with reference to FIG. 2. The sliding gate 1 illustrated in FIG. 2 has three plates 2 and includes an upper fixed plate 3, a slide plate 4, and a lower fixed plate 5 from an upstream side. Each plate 2 includes the flow path hole 6 which has a cylindrical shape of which a cross section in an axial direction is a perfect circle and in which the axial direction of the cylinder is a direction inclined from the vertical downstream direction 32. The upper fixed plate 3 will be described as an example with reference to (A) and (F) of FIG. 2. (F) of FIG. 2 is a cross-sectional view taken along a line F-F of (A) of FIG. 2. Since the axial direction of the cylindrical shape formed by the flow path hole 6 is inclined with respect to vertical downstream direction 32, the upstream open hole 8*u* and the downstream open hole 8*d* are drawn at different positions in a plan view of (A) of FIG. 2. Since the cross section in the axial direction is a perfect circle and the axial direction is a cylindrical shape inclined from the vertical downstream direction 32, each of the upstream open hole 8*u* and the downstream open hole 8*d* forms an ellipse slightly deviated from a perfect circle. However, each of the upstream open hole 8*u* and the downstream open hole 8*d* is drawn as a perfect circle on the drawings for convenience. The centers of gravity of the figures of the upstream open hole 8*u* and the downstream open hole 8*d* can be determined as a centroid 9*u* of the upstream open hole and a centroid 9*d* of the downstream open hole. Further, a flow path axial direction 10 can be defined so as to pass through the centroid 9*u* of the upstream open hole and the centroid 9*d* of the downstream open hole and to be directed to the downstream side. In (F) of FIG. 2, a line drawn by a dashed line is the flow path axial direction 10. In the example illustrated in FIG. 2, the flow path axial direction 10 coincides with an axial direction of a cylindrical shape which forms the flow path hole 6 and has a perfect circular cross section in the axial direction. Here, an angle formed between the downstream direction (the vertical downstream direction 32) perpendicular to the sliding surface 30 of the plate 2 and the flow path axial direction 10 is referred to as a flow path vertical angle $\alpha$. Here, the reason why the centroid of the opening is used instead of a center of a circle to determine the flow path axial direction is to define the flow path axial direction universally even when the opening shape is not a perfect circle.

In the example of the prior art illustrated in FIG. 10, a sliding position of the slide plate 4 is determined so that the downstream open hole 8*d* of the upper fixed plate 3 and the upstream open hole 8*u* of the slide plate 4 coincide with each other and the downstream open hole 8*d* of the slide plate 4 and the upstream open hole 8*u* of the lower fixed plate 5 coincide with each other, that is, the sliding gate 1 is in a fully open state (refer to (D) of FIG. 10). In the sliding gate 1 illustrated in FIG. 10, it is possible to reduce an opening of the sliding gate 1 from the fully open state by moving the slide plate 4 to the left in FIG. 10. FIG. 11 illustrates a state where the opening of the same sliding gate 1 as that of FIG. 10 is made 1/2. By further moving the position of the slide plate 4 to the left side in FIG. 10, the sliding gate 1 can be fully closed.

Figure 3:
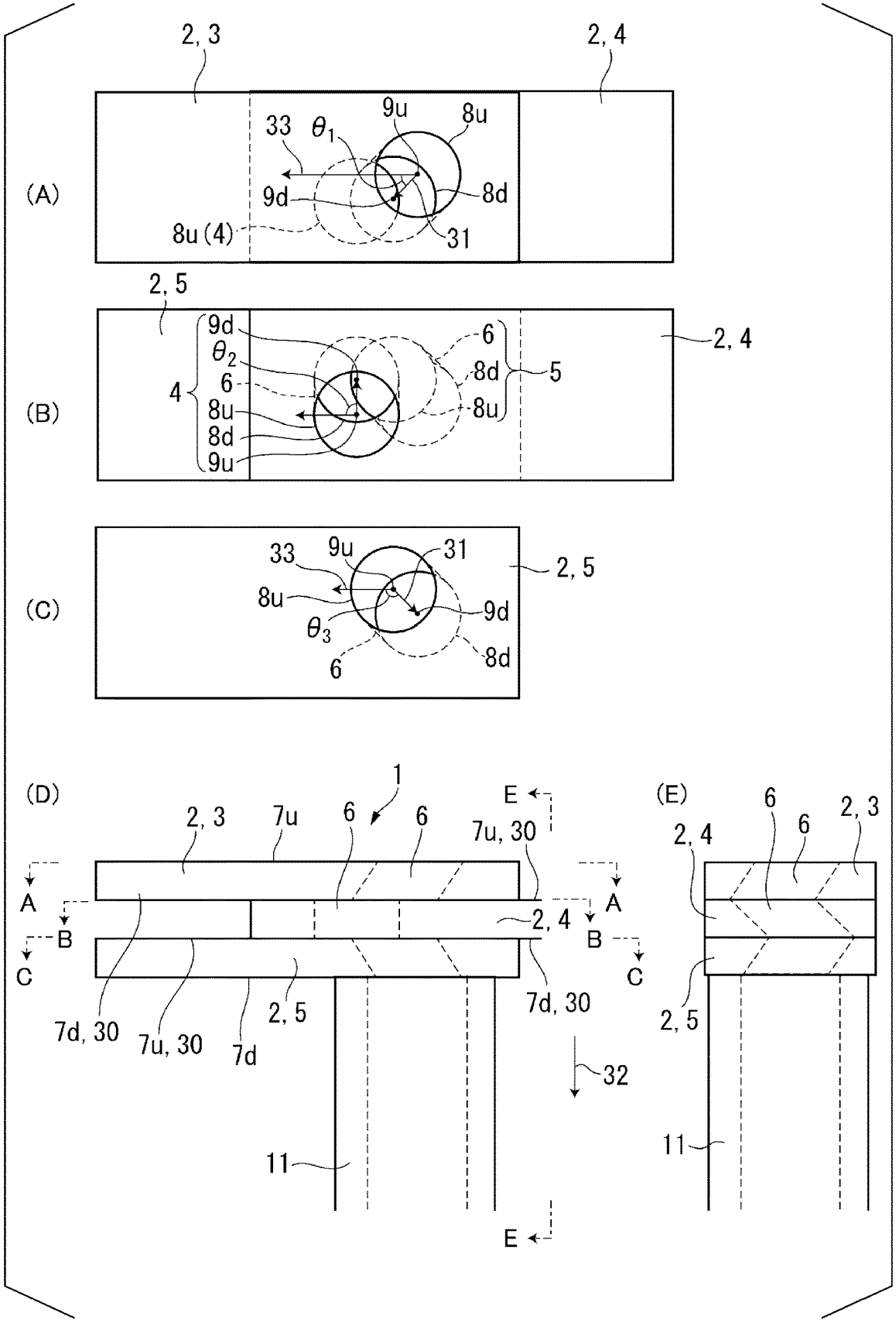
FIG. 3 is a view illustrating the sliding gate, (A) is a view taken along line A-A of (D), (B) is a view taken along line B-B of (D), (C) is a view taken along line C-C of (D), (D) is a front view in which the sliding gate and the ladle shroud are combined with each other, and (E) is a view taken along line E-E of (D).

The same applies to the example illustrated in FIGS. 2 and 3. In FIG. 2, the sliding gate 1 is fully open, and the sliding position of the slide plate 4 is determined so that the downstream open hole 8*d* of the upper fixed plate 3 and the upstream open hole 8*u* of the slide plate 4 coincide with each other, and the downstream open hole 8*d* of the slide plate 4 and the upstream open hole 8*u* of the lower fixed plate 5 coincide with each other. FIG. 3 illustrates a state where in the same sliding gate 1 as that of FIG. 2, an opening of the sliding gate 1 is made 1/2. Hereinafter, a direction in which the slide plate 4 slides when the sliding gate 1 is closed is referred to as a "sliding closing direction 33".

In the present embodiment illustrated in FIG. 2, the flow path axial direction 10 is inclined at the flow path vertical angle $\alpha$ with respect to the vertical downstream direction 32. Therefore, when a direction in which the flow path axial direction 10 is projected on the sliding surface 30 is defined as a flow path axial direction projected on sliding surface 31, the flow path axial direction projected on sliding surface 31 can be determined. In each of (A) to (C) and (F) of FIG. 2, the flow path axial direction projected on sliding surface 31 is indicated by a thin line arrow. Moreover, in (A) to (C) of FIG. 2, the flow path axial direction projected on sliding surface 31 overlaps the flow path axial direction 10. Further, in the example illustrated in FIG. 10, since the flow path axial direction 10 is directed in the vertical downstream direction 32, the flow path axial direction projected on sliding surface 31 does not appear in the plan views illustrated in (A) to (C) of FIG. 10.

Next, an angular relationship between the flow path axial direction projected on sliding surface 31 and the sliding closing direction 33 will be defined. An angle between the sliding closing direction 33 and the flow path axial direction projected on sliding surface 31 clockwise when viewed in the vertical downstream direction 32 is referred to as a flow path horizontal angle $\theta$. The flow path horizontal angle $\theta$ is defined as an angle within a range of±180°. That is, when the flow path axial direction projected on sliding surface 31 has an angle ($\theta'$) more than +180° clockwise as viewed in the vertical downstream direction 32, the angle $\theta$ is determined as a negative value with "$\theta=\theta'-360°$". As a subscript of the angle $\theta$, $\theta$ of the plate 2 on the most upstream side is numbered by $\theta_1$, $\theta$ of the plate 2 on the downstream side is numbered by $\theta_2$, and $\theta$ of the plate 2 on the downstream side is numbered by $\theta_3$ in order. When represented as $\theta_N$ as a representative, N is an integer of 1 or more and means a numerical value up to a numerical value of plates of the sliding gate 1. In the example illustrated in FIG. 2, the upper fixed plate 3 has an angle $\theta_1=-45°$, the slide plate 4 has an angle $\theta_2=+90°$, and the lower fixed plate 5 has an angle $\theta_3=-135°$.

Further, in the sliding gate 1, the relationship of the flow path horizontal angle $\theta$ between the two plates 2 which are in contact with each other is defined as follows. That is, the total number of the plurality of plates 2 is N using an integer N of 1 or more. Then, the flow path horizontal angles $\theta$ of the plurality of plates 2 are sequentially set to $\theta_1, \theta_2, \ldots \theta_N$ from the plate 2 on the most upstream side to the Nth plate. Then, $\Delta\theta_n$ is determined as an angle $\Delta\theta_n=\theta_N-\theta_{N+1}$ (n is an integer of 1 or more and up to the number of plates−1). $\Delta\theta_n$ is defined as an angle in a range of±180°, similarly to $\theta_N$ described above. That is, when $\Delta\theta_n$ is an angle ($\Delta\theta_n'$) more than +180°, $\Delta\theta_n$ is determined as a negative value with "$\Delta\theta_n=\Delta\theta_n'-360°$". In addition, when $\Delta\theta_n$ is an angle less than −180° ($\Delta\theta_n'$), $\Delta\theta_n$ is determined as a positive value with "$\Delta\theta_n=\Delta\theta_n'+360°$". Accordingly, $\Delta\theta_n$ is a number within the range of±180°. Here, when $\Delta\theta_n$ is more than 0° and less than +180°, it indicates that the flow path horizontal angle $\theta_N$ is changed counterclockwise from the upstream side to the downstream side. Conversely, when $\Delta\theta_n$ is more than −180° and less than 0°, it indicates that the flow path horizontal angle $\theta_N$ is changed clockwise from the upstream side to the downstream side. In the example illustrated in FIG. 2, since $\Delta\theta_1=\theta_1-\theta_2=-135°$ and $\Delta\theta_2'=\theta_2-\theta_3=225°$, $\Delta\theta_2=\Delta\theta_2'-360°=-135°$. Since both $\Delta\theta_1$ and $\Delta\theta_2$ are in the range of −180° to 0°, this indicates that the flow path horizontal angle θ is changed clockwise.

With the above preparations, conditions that the sliding gate 1 of the present embodiment should have and reasons therefor will be described.

In the sliding gate 1 of the related art, as illustrated in FIGS. 10 and 11, the flow path axial direction 10 is perpendicular to the sliding surface 30, that is, the flow path vertical angle α is 0° and has no inclination. A first feature of the present embodiment is that the flow path axial direction 10 is inclined with respect to the vertical downstream direction 32 and the flow path vertical angle α is not 0°. Since the flow path axis is inclined with respect to the vertical downstream direction 32, the molten metal flowing in the plate has not only a velocity component in the vertical downstream direction 32 but also a velocity component (in the case of general continuous casting, a velocity component in the horizontal direction) perpendicular to the vertical downstream direction 32. In the present embodiment, the flow path vertical angle α is 5° or more and 75° or less. By setting the angle α to 5° or more, the molten metal 21 has a sufficient velocity component in the horizontal direction, and the turning flow can be formed in the ladle shroud 11 as described below. The angle α is preferably 10° or more, more preferably 15° or more. Meanwhile, if the angle α is too large, it is not preferable from the viewpoint of securing a strength of a refractory material forming the flow path hole 6 and suppressing wear thereof. Accordingly, the angle α is set to 75° or less. The angle α is preferably 65° or less, more preferably 55° or less.

Regarding an opening state of the sliding gate 1 during the continuous casting, in a steady state where a level of the molten metal surface in the tundish 15 is constant and casting is performed at a constant casting speed, in both of the sliding gate 1 in the bottom part of the ladle 14 and the sliding gate 1 in the bottom part of the tundish 15, the opening of the sliding gate 1 is not fully open (refer to FIG. 10), and the opening of the sliding gate 1 is selected so that the casting can be performed in a state (refer to FIG. 11) where the opening is narrowed. FIG. 11 illustrates that the opening of the sliding gate 1 is 1/2. In this case, an opening area of the sliding gate 1 is calculated to be 0.31 times an opening area of the flow path hole 6 which is a perfect circle. During the steady continuous casting, the small area narrowed in this way is the opening area. As a result, a flow having a large maximum flow velocity occurs in the flow path on the downstream side of the slide plate 4 of the sliding gate 1.

FIG. 3 illustrates the sliding gate 1 when the opening of the sliding gate 1 (the opening is fully open) of the present embodiment having the shape illustrated in FIG. 2 is changed and the opening is 1/2. (A) of FIG. 3 is a view taken along line A-A of (D), in which the downstream open hole 8*d* of the upper fixed plate 3 is drawn partially by solid lines and partially by broken lines, and with respect to the slide plate 4, similarly, only the upstream open hole 8*u*(4) is drawn partially by solid lines and partially by broken lines. (B) of FIG. 3 is a view taken along line B-B of (D), in which the entire upstream open hole 8*u* of the slide plate 4 is drawn by solid lines, the downstream open hole 8*d* is drawn partially by solid lines and partially by broken lines, and similarly, the upstream open hole 8*u* of the lower fixed plate 5 is drawn partially by solid lines and partially by broken lines, and the entire downstream open hole 8*d* thereof is drawn by broken lines. (C) of FIG. 3 is a view taken along line C-C of (D), in which the entire upstream open holes 8*u* of the lower fixed plate 5 is drawn by solid lines, and the downstream open hole 8*d* is drawn partially by solid lines and partially by broken lines.

Figure 4:
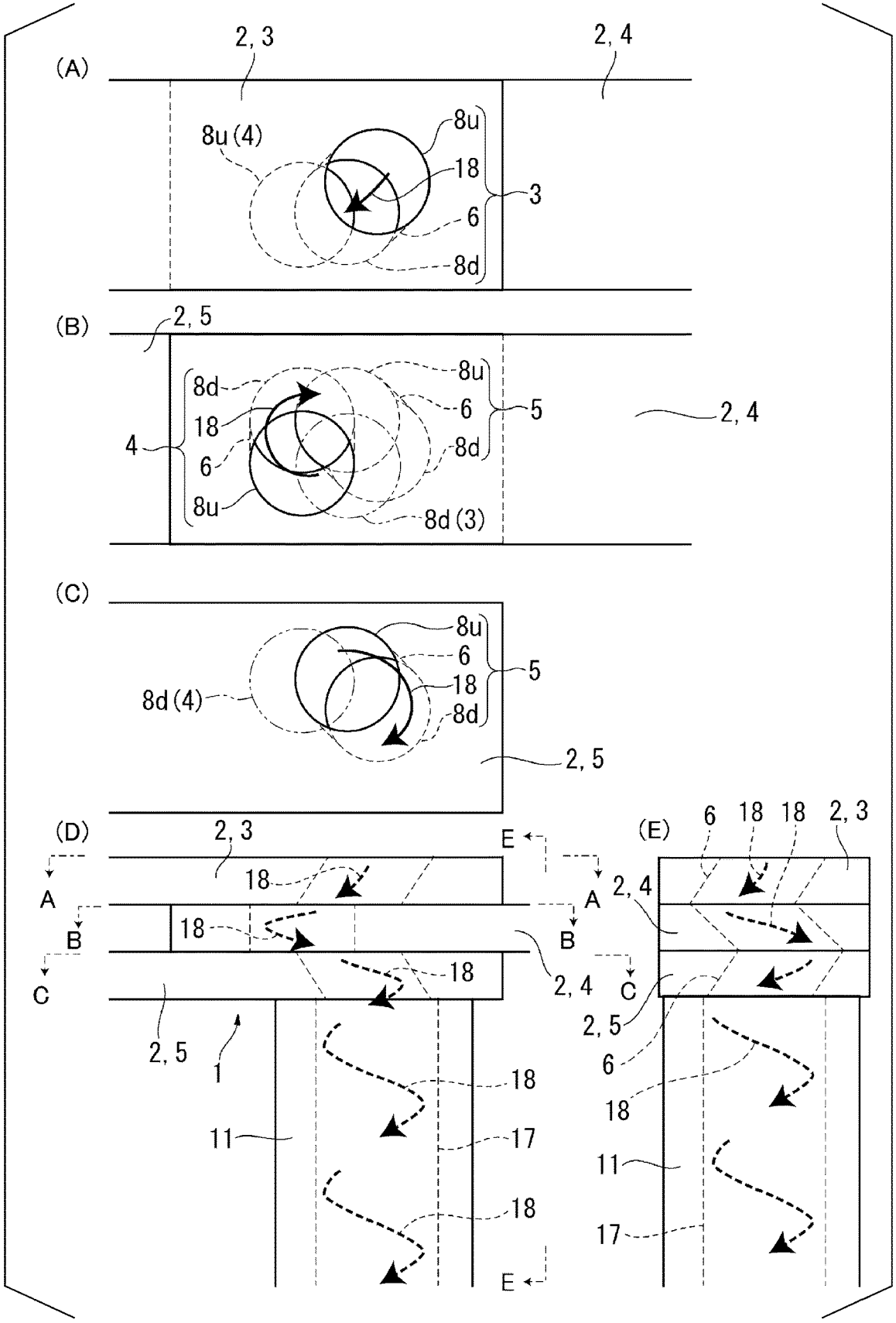
FIG. 4 is a view illustrating a flow of molten metal in the sliding gate, (A) is a view taken along line A-A of (D), (B) is a view taken along line B-B of (D), (C) is a view taken along line C-C of (D), (D) is a front view in which the sliding gate and the ladle shroud are combined with each other, and (E) is a view taken along line E-E of (D).

When the opening is 1/2 as illustrated in FIG. 3, the flows of the molten metal 21 in the flow path hole 6 of the sliding gate 1 and the ladle shroud 11 will be described with reference to FIG. 4. In FIG. 4, (A) of FIG. 4 is a view taken along line A-A of (D), in which the downstream open hole 8*d* of the upper fixed plate 3 is drawn partially by solid lines and partially by broken lines, and with respect to the slide plate 4, similarly, only the upstream open hole 8*u* is drawn partially by solid lines and partially by broken lines. (B) of FIG. 4 is a view taken along line B-B of (D), in which the position of the downstream open hole 8*d*(3) of the upper fixed plate 3 is indicated by two-dot chain lines, the entire upstream open hole 8*u* of the slide plate 4 is drawn by solid lines, the downstream open hole 8*d* is drawn partially by solid lines and partially by broken lines, and similarly, the upstream open hole 8*u* of the lower fixed plate 5 is drawn partially by solid lines and partially by broken lines, and the entire downstream open hole 8*d* thereof is drawn by broken lines. (C) of FIG. 4 is a view taken along line C-C of (D), in which the position of the downstream open hole 8*d*(4) of the slide plate 4 is indicated by two-dot chain lines, the entire upstream open holes 8*u* of the lower fixed plate 5 is drawn by solid lines, and the downstream open hole 8*d* is drawn partially by solid lines and partially by broken lines. Moreover, streamlines 18 of the molten metal are indicated by thick arrows in (A) to (C) of FIG. 4 and by thick broken arrows in (D) and (E) of FIG. 4.

In the sliding gate 1 of FIGS. 2 and 3, as described above, the difference $\Delta\theta_n$ between the adjacent flow path horizontal angles $\theta_N$ is $\Delta\theta_1=\Delta\theta_2=-135°$, and in any case, $\Delta\theta_n$ is more than −180° and less than 0°. Accordingly, the flow path horizontal angle $\theta_N$ is changed clockwise from the upstream side to the downstream side. The molten metal flowing through the flow path hole 6 of the upper fixed plate 3 flows along the flow path axial direction 10 of the upper fixed plate 3 as illustrated in (A) of FIG. 4. At a contact surface between the upper fixed plate 3 and the slide plate 4, the molten metal flows to the downstream side in a small cross section of an overlapping part (opening part) between the downstream open hole 8*d* (two-dot chain line in (B) of FIG. 4) of the upper fixed plate 3 and the upstream open hole 8*u* (solid line in (B) of FIG. 4) of the slide plate 4. In the flow path hole 6 of the slide plate 4, as illustrated by the streamline 18 in (B) of FIG. 4, the flow of the molten metal flowing out from the small cross section of the overlapping part (opening part) between the downstream open hole 8*d* (two-dot chain line in (B) of FIG. 4) of the upper fixed plate 3 and the upstream open hole 8*u* (solid line in (B) of FIG. 4) of the slide plate 4 forms the turning flow along an inner wall surface (cylindrical surface) of the flow path hole 6 of the slide plate 4. Moreover, on the downstream side thereof, the molten metal further flows out into the flow path hole 6 of the lower fixed plate 5 from a small cross section of an overlapping part (opening part) between the downstream open hole 8*d* (two-dot chain line in (C) of FIG. 4) of the slide plate 4 and the upstream open hole 8*u* (solid line in (C) of FIG. 4) of the lower fixed plate 5. In the flow path hole 6 of the lower fixed plate 5, as illustrated by the streamline 18 in (C) of FIG. 4, the turning flow is formed along an inner wall surface (cylindrical surface) of the flow path hole 6 of the lower fixed plate 5. Then, as it is, the molten metal flows out into the ladle shroud 11 on the downstream side, and as illustrated in (D) and (E) of FIG. 4, the streamline 18 in the flow path 17 moves to the downstream side in the ladle shroud 11 while maintaining the turning flow.

When the sliding gate 1 of the related art as illustrated in FIG. 11 is used, all of kinetic energy of the molten metal flow when flowing out from the opening part of the sliding gate 1 is spent on the flow velocity in the downstream direction. When the sliding gate 1 of the present embodiment as illustrated in FIG. 3 is used and the molten metal flows out from the sliding gate 1, the molten metal flow is turned with the flow velocity in the downstream direction and kinetic energy of the molten metal flow is dispersed into the flow velocity in the downstream direction and a turning velocity turning around the inner circumferential surface of the ladle shroud 11. Accordingly, as compared with the sliding gate 1 of the related art illustrated in FIG. 11, it is possible to suppress a maximum flow velocity in the downstream direction. As a result, in a case where the ladle shroud 11 is a long nozzle 12, even when the molten metal 21 flows out from a lower end of the ladle shroud 11 into the molten metal 21 in the tundish 15, the flow velocity component flowing from the lower end of the ladle shroud 11 in the radial direction exists due to the turning flow in the ladle shroud 11. Therefore, it is possible to suppress the maximum flow velocity downward from the lower end of the ladle shroud 11.

The turning flow is formed in the flow path hole 6 of the sliding gate 1, and the turning flow is also formed in the ladle shroud on the downstream side of the sliding gate 1. Accordingly, a condition of the angle $\Delta\theta_n$ which is a difference between the flow path horizontal angles $\theta_N$ of the plates 2 adjacent to each other will be described. As described above, $\Delta\theta_n$ is defined as an angle in the range of±180°. Here, when $\Delta\theta_n$ is more than −10° and less than +10°, the difference between the flow path horizontal angles $\theta_N$ and $\theta_{N+1}$ is too small. Accordingly, the turning flow cannot be formed. When $\Delta\theta_n$ is +170° or more or −170° or less, the absolute value of $\Delta\theta_n$ is too large. Accordingly, the formation of the turning flow is rather hindered. When the sliding gate 1 has two plates, only $\Delta\theta_1$ is defined, and it is sufficient that $\Delta\theta_1$ satisfies the condition. When the sliding gate 1 has three or more plates, $\Delta\theta_2$ and further $\Delta\theta_n$ are defined in addition to $\Delta\theta_1$. Further, it is necessary that all angles $\Delta\theta_n$ are each 10° or more and less than 170°, or all the angles $\Delta\theta_n$ are more than −170° and −10° or less. Thus, when the flow path axial directions 10 of the first and second plates of the plate 2 are changed clockwise, the third and subsequent plates are also changed clockwise in the same manner, and when the flow path axial directions 10 of the first and second plates of the plate 2 are changed counterclockwise, the third and subsequent plates are also changed counterclockwise in the same manner. Accordingly, the turning flow can be effectively formed in the sliding gate 1. A more preferable range of $\Delta\theta_n$ is 30° or more and less than 165°, or more than −165° and −30° or less.

Figure 5:
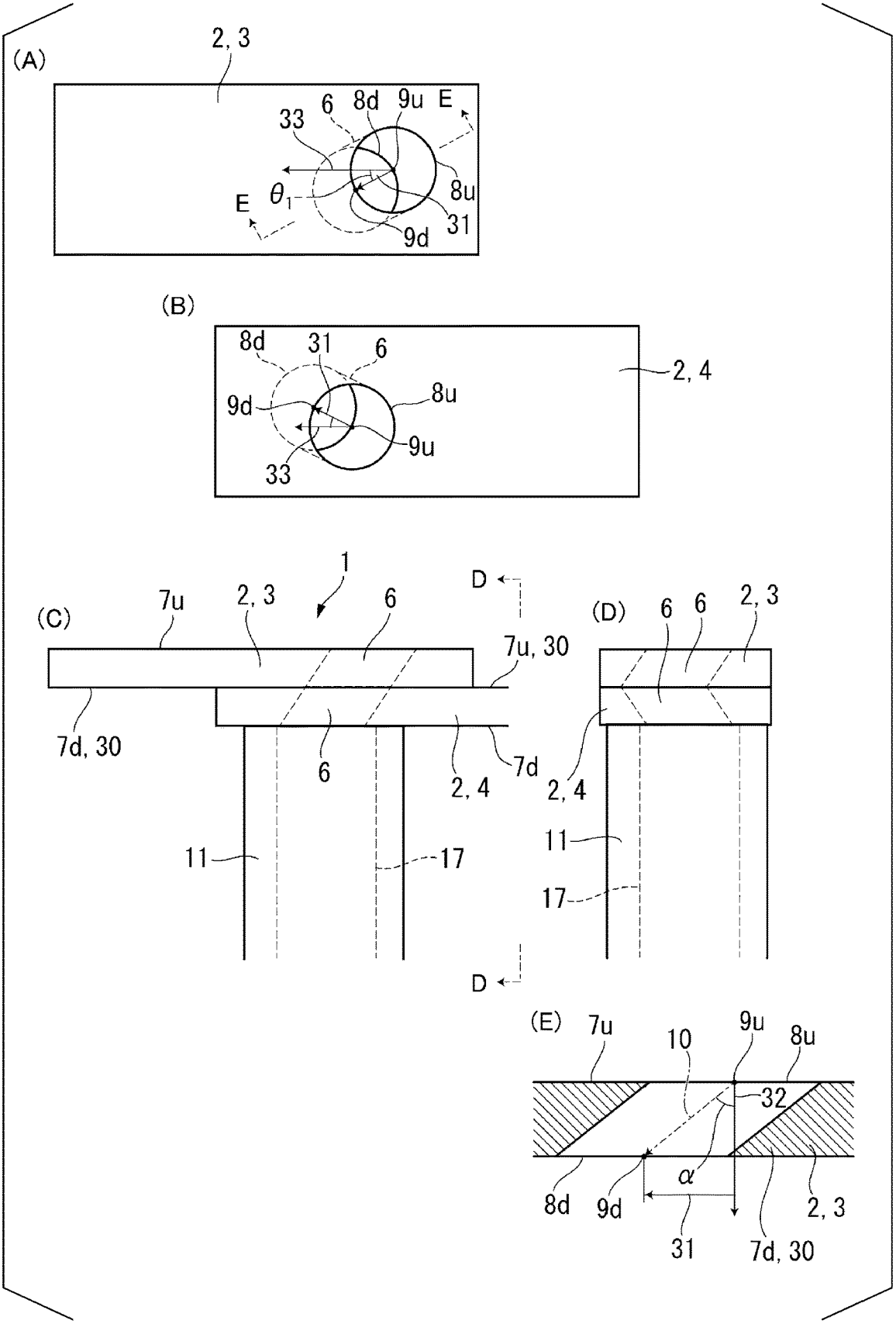
FIG. 5 is a view illustrating a modification example of the sliding gate according to the embodiment, (A) is a view of an upper fixed plate, (B) is a view of a slide plate, (C) is a front view in which a sliding gate and a ladle shroud are combined with each other, (D) is a view taken along line D-D of (C), and (E) is a cross-sectional view taken along line E-E of (A).
Figure 6:
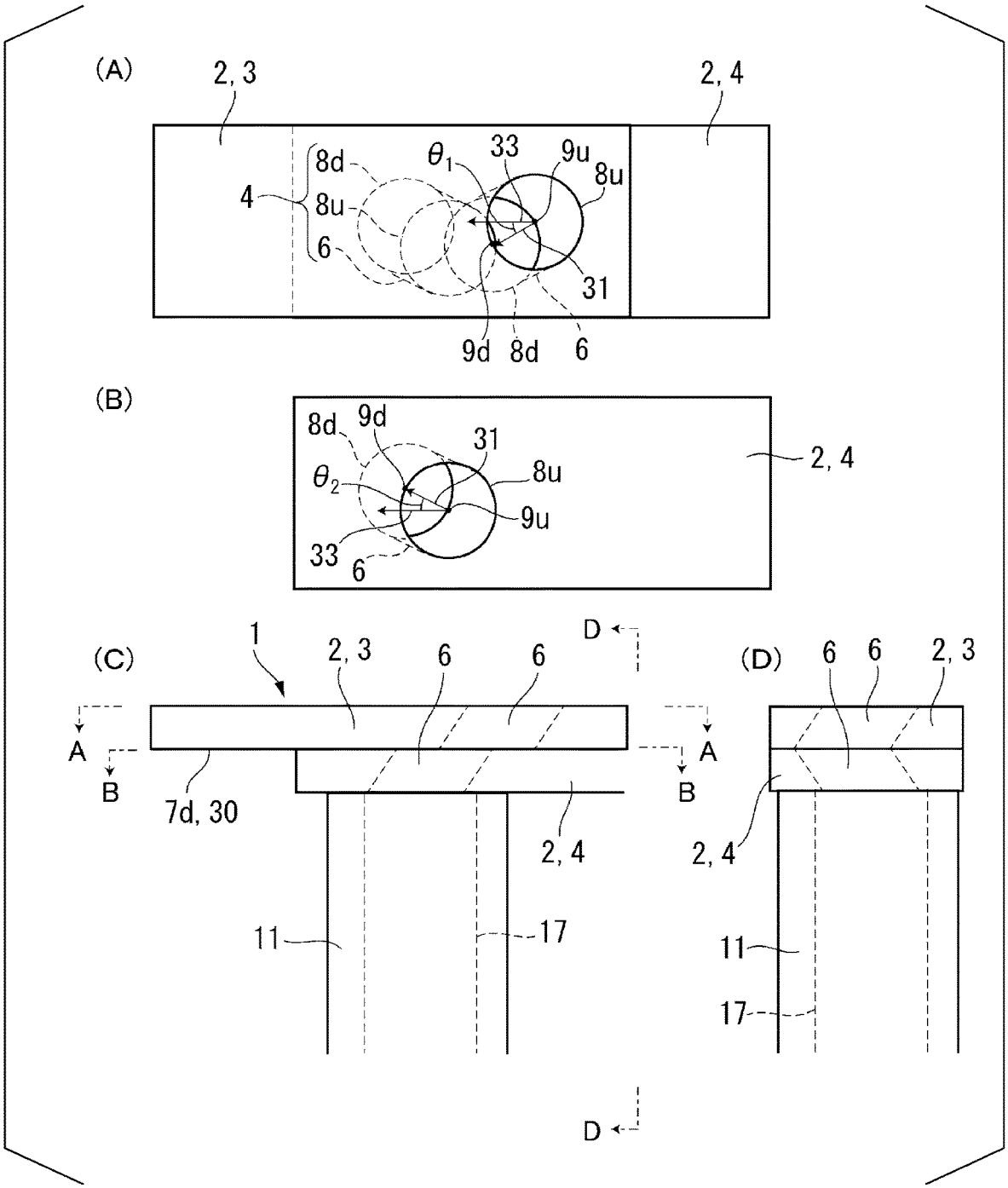
FIG. 6 is a view illustrating another modification example of the sliding gate according to the embodiment, (A) is a view taken along line A-A of (C), (B) is a view taken along line B-B of (C), (C) is a front view in which a sliding gate and a ladle shroud are combined with each other, and (D) is a view taken along line D-D of (C).

The number of the plates 2 forming the sliding gate 1 is preferably two or three. The example illustrated in FIGS. 2 to 4 is the case where the number of the plates 2 is three as described above. In FIGS. 5 and 6, the number of the plates 2 is two, a first plate from an upstream side constitutes the upper fixed plate 3 and the second plate constitutes the slide plate 4. FIG. 5 illustrates a case where the opening is fully open, and FIG. 6 illustrates a case where the opening is 1/2. $\alpha$=51.95°, $\theta_1$=−26.57°, $\theta_2$=+26.57°, $\Delta\theta_1$=−53.14°, and a clockwise turning flow can be formed. The reason why the number of the plates 2 forming the sliding gate 1 is preferably two or three is because at least two plates 2 are required to develop a throttling mechanism of the sliding gate 1, four or more plates 2 are not necessary for adjusting a flow rate, and thus, the cost increases as the number of plates 2 increases.

Figure 7:
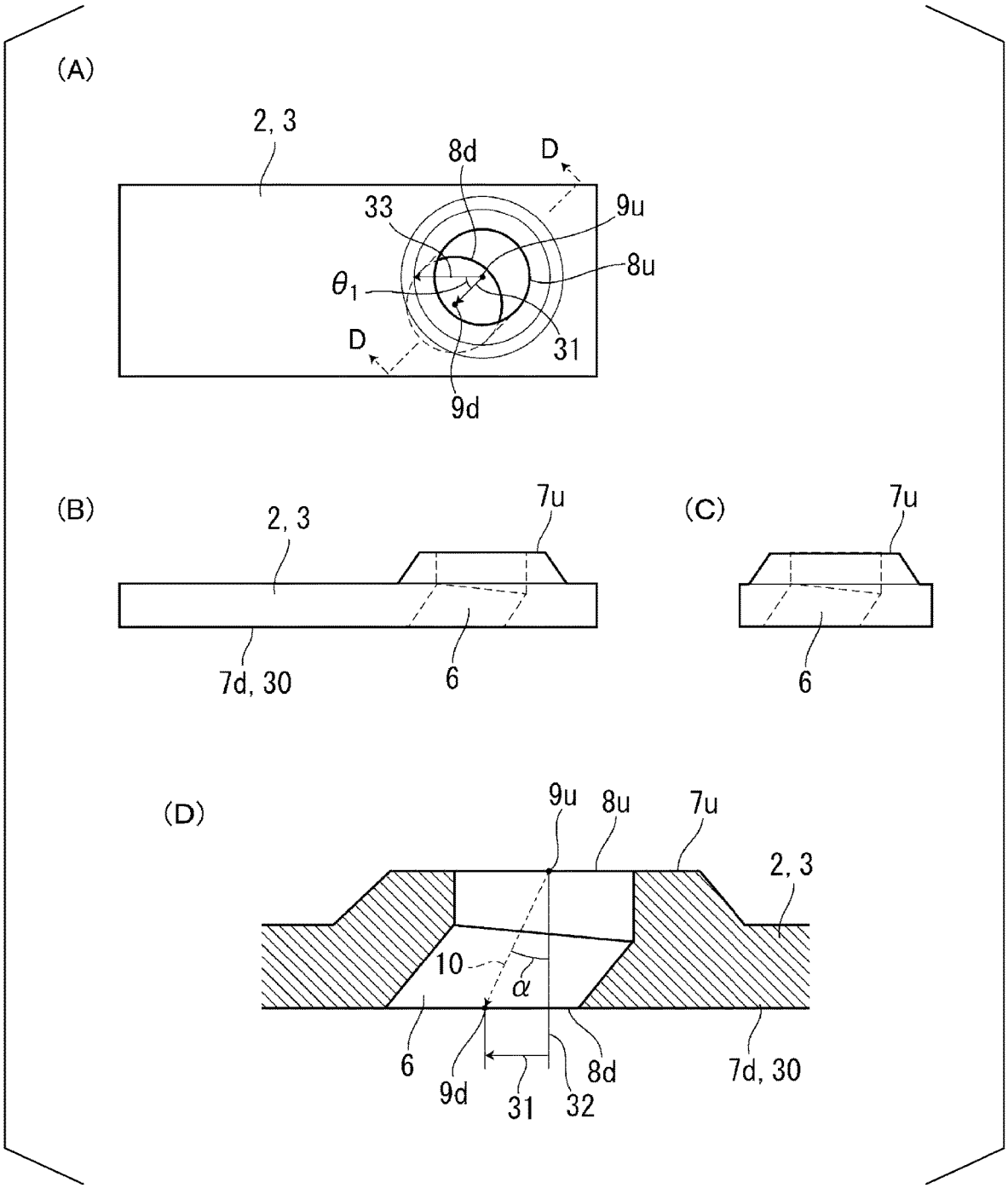
FIG. 7 is a view illustrating still another modification example of the sliding gate according to the embodiment and illustrating an example of an upper fixed plate included in the sliding gate, (A) is a plan view, (B) is a front view, (C) is a side view, and (D) is a cross-sectional view taken along line D-D of (A).
Figure 8:
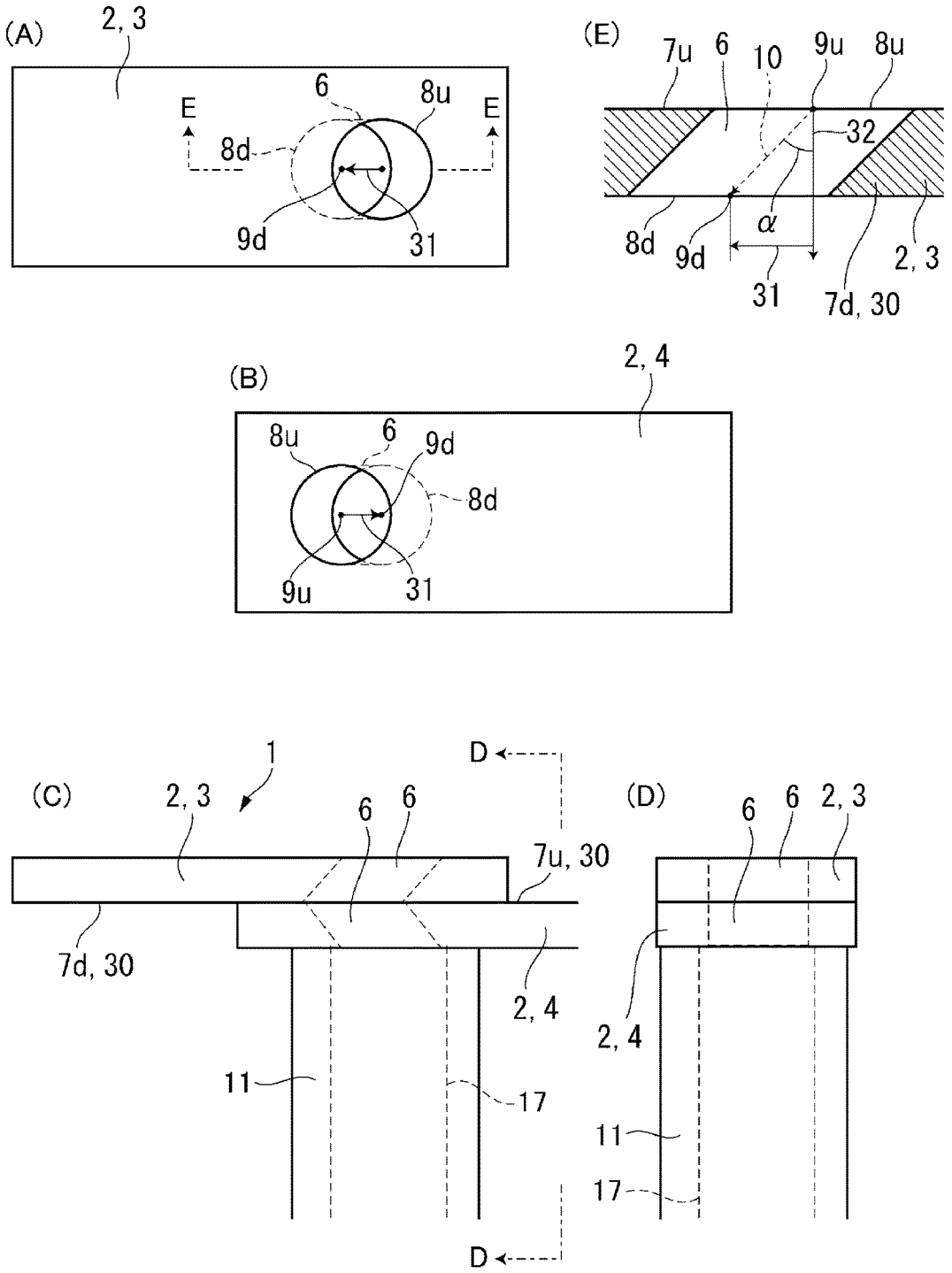
FIG. 8 is a view illustrating a sliding gate of a comparative example, (A) is an upper fixed plate, (B) is a slide plate, (C) is a front view in which a sliding gate and a ladle shroud are combined with each other, (D) is a view taken along line D-D of (C), and (E) is a cross-sectional view taken along line E-E of (A).
Figure 9:
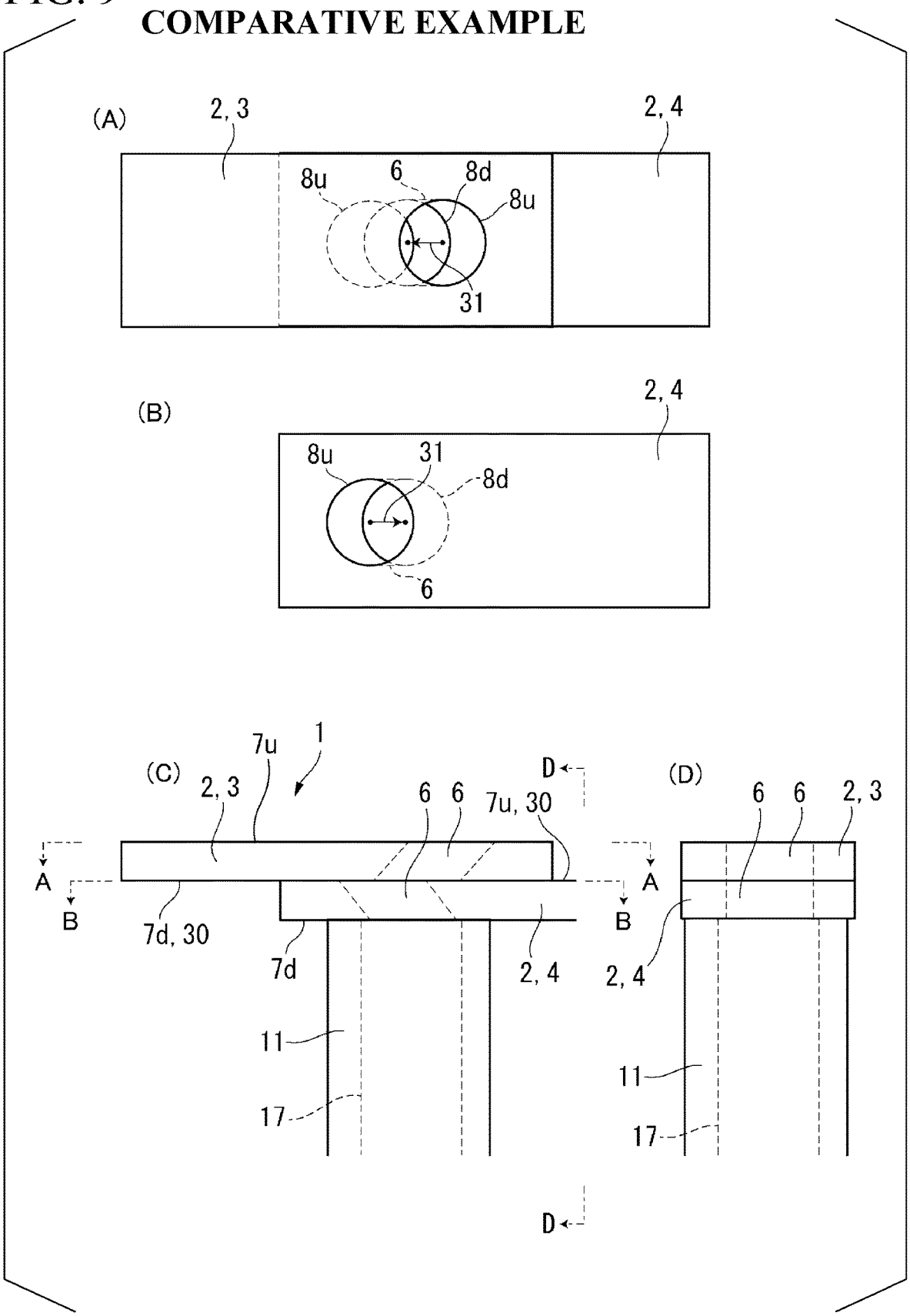
FIG. 9 is a view illustrating the sliding gate of the comparative example, (A) is a view taken along line A-A of (A), (B) is a view taken along line B-B, (C) is a front view in which the sliding gate and the ladle shroud are combined with each other, and (D) is a view taken along line D-D of (C).

The flow path hole 6 formed in the plate 2 may be a flow path hole 6 having a shape as illustrated in FIG. 7. FIG. 7 illustrates an example of the upper fixed plate 3. From an upstream surface 7*u* of the plate 2 to a middle of a thickness of the plate 2, the shape of the flow path hole 6 is a cylindrical shape having a perfect circular cross section, and an axis of the cylinder is directed in the vertical downstream direction 32. From a downstream surface 7*d* of the plate 2 to the middle of the thickness of the plate 2, the shape of the flow path hole 6 is a cylindrical shape having a perfect circular cross section, and an axis of the cylinder is formed to be inclined from the vertical downstream direction 32. In the middle of the thickness of the plate 2, the flow path hole 6 from the upstream surface 7*u* and the flow path hole 6 from the downstream surface 7*d* are connected to each other without a step. Also in the plate 2 having the flow path hole 6 having this shape, as illustrated in (D) of FIG. 7, a direction from a centroid (centroid 9*u* of upstream open hole) of an upstream-side surface open hole figure toward a centroid (centroid 9*d* of downstream open hole) of a downstream-side surface open hole figure can be defined as a flow path axial direction 10.

Moreover, in the following examples and comparative examples, the thicknesses of the plates 2 forming the sliding gate 1 are the same. However, the thickness may be different for each plate 2 such as the thinnest slide plate 4. In addition, in the examples and comparative examples, a case where in which shapes of flow path holes of inlet and outlet of each plate 2 of the sliding gate 1 are circles of the same size is illustrated. However, even if the shape of each flow path hole is oval or ellipse, and the turning flow can be obtained as long as requirements of the present invention are satisfied. Alternatively, the opening area of the flow path hole may be different between the inlet and the outlet of each plate 2.

The angle $\alpha$ may be applied from the middle, such as 0° at an upper portion of the upper fixed plate 3 and 30° at the lower portion thereof. Moreover, the angle can be gradually changed. The angle $\alpha$ may be the same or different for all the plates 2.

EXAMPLES

Hereinafter, the contents of the present embodiment will be specifically described with reference to examples.

FIG. 1 illustrates a configuration from the ladle 14 to the mold 16 of a continuous casting machine for the molten metal. In the embodiment, molten steel is assumed as the molten metal 21. For example, when the present embodiment is applied to the sliding gate 1 of the ladle 14, the following effects can be expected. That is, the turning flow can be formed in the ladle shroud 11 (long nozzle 12) connected to the downstream side of the sliding gate 1, the maximum flow velocity of the flow discharged into the molten steel in the tundish 15 from the lower end of the ladle shroud 11 can be reduced, the viscous flow in the tundish 15 can be rectified, and a floating removal of nonmetallic inclusions can be promoted. The shape of the sliding gate 1 of the present example will be exemplified below.

Here, the plates 2 of the sliding gate 1 having the three plates 2 are referred to as the upper fixed plate 3, the slide plate 4, and the lower fixed plate 5 in order from the top. In a case of a sliding gate 1 having two plates 2, the plates are referred to as the upper fixed plate 3 and the slide plate 4 in order from the top.

With respect to the flow path vertical angle α between the downstream direction (the vertical downstream direction 32) perpendicular to the sliding surface 30 of the plate 2 and the flow path axial direction 10, and the flow path horizontal angle θ (range of±180°) which is the angle of the flow path axial direction projected on sliding surface 31 formed clockwise when viewed in the vertical downstream direction 32, subscripts 1, 2 (, 3) are sequentially attached to the plates from the plate 2 on the most upstream side. With respect to the flow path vertical angle α, α of the plate 2 on the most upstream side is $\alpha_1$, α of the plate 2 on the downstream side is $\alpha_2$, and α of the plate 2 on the downstream side is $\alpha_3$, in order. With respect to the flow path horizontal angle θ, θ of the plate on the most upstream side plate 2 is $\theta_1$, θ of the plate of the downstream side is $\theta_2$, and θ of the plate on the downstream side is $\theta_3$, in order.

With respect to the ladle 14 and the tundish 15, the effects of the present invention were confirmed using a water model experimental machine which was 1/1 of the actual machine. The thickness of each plate 2 of the sliding gate 1 was 35 mm, the shape of the flow path hole 6 formed in the plate 2 was a perfect circular shape having a diameter of 80 mm, and the flow path vertical angle α and the flow path horizontal angle θ were set to predetermined angles. The long nozzle 12 serving as the ladle shroud 11 provided below the sliding gate 1 had an inner diameter of 100 mm, and the lower end of the long nozzle 12 was immersed in a water bath in the tundish 15. A height from a water surface in the ladle 14 to a position of the sliding gate 1 was 3 m, a height from the sliding gate 1 at a bottom part of the ladle 14 to a water surface in the tundish 15 was 1 m, the position of the slide plate 4 of the sliding gate 1 was adjusted so that the opening was set to 30 mm (closed by 50 mm from full opening), and water flowed out from the sliding gate 1 in a steady state while maintaining the water surface position in the tundish 15 at a constant height.

At the lower end position of the long nozzle 12, a flow velocity of the water flowing out from the lower end of the long nozzle 12 into the tundish 15 in each flow direction was measured by a laser Doppler method. At the lower end position of the long nozzle 12, a "turning flow evaluation result" was expressed as "GOOD" when there was the horizontal flow velocity, and the "turning flow evaluation result" was expressed as "BAD" when there was no horizontal flow velocity.

TABLE 1

| | Number | Number of plates | Flow path axial line inclination angle (degree) $\alpha_1$ | $\alpha_2$ | $\alpha_3$ | Flow path axial line rotation angle (degree) $\theta_1$ | $\theta_2$ | $\theta_3$ | Flow path axial line rotation angle difference (degree) $\Delta\theta_1$ | $\Delta\theta_2$ | Turing flow evaluation |
|---|---|---|---|---|---|---|---|---|---|---|---|
| Present invention example | A | 3 | 38.94 | 48.81 | 38.94 | −45 | 90 | −135 | −135 | −135 | GOOD |
| | B | 2 | 52.95 | 52.95 | — | −26.57 | 26.57 | — | −53.14 | — | GOOD |
| Comparative Example | C | 2 | 48.81 | 48.81 | — | 0 | 180 | — | −180 | — | BAD |
| | D | 3 | 0 | 0 | 0 | — | — | — | — | — | BAD |

In Example A of the present invention (refer to Table 1 and FIGS. 2 to 4), the upper fixed plate 3 of the three-plate sliding gate 1 had an oblique hole of $\theta_1$=−45°, the slide plate 4 had an oblique hole of $\theta_2$=90°, and the lower fixed plate 5 had an oblique hole of $\theta_3$=−135°. Table 1 illustrates the flow path vertical angles α1 to α3. According to a combination thereof, even if the sliding gate 1 was fully open or throttled, the circumferential flow velocity was applied to the molten metal flow, and the turning flow could be formed inside the flow path 17 of the ladle shroud 11 attached below the sliding gate 1. The turning flow evaluation result was GOOD.

Moreover, in Example A of the present invention, the outlet (downstream open hole 8*d*) of the lower fixed plate 5 was located immediately below the inlet (upstream open hole 8*u*) of the upper fixed plate 3. In this case, the present invention could be applied only by replacing the three plates 2 of the sliding gate 1 from the example of the related art illustrated in FIGS. 10 and 11 to the example of the present invention illustrated in FIGS. 2 and 3.

In Example B of the present invention (refer Table 1 and FIGS. 5 and 6), the upper fixed plate 3 of the two-plate sliding gate 1 had an oblique hole of $\theta_1$=−26.57° and the slide plate 4 had an oblique hole of $\theta_2$=26.57°. Table 1 illustrates the flow path vertical angles α1 and α2. According to a combination thereof, even if the sliding gate 1 was fully open or throttled, the circumferential flow velocity was applied to the molten metal flow, and the turning flow could be formed inside the flow path 17 of the ladle shroud 11 attached below the sliding gate 1. Moreover, in Example B of the present invention, since a sliding locus of the outlet (downstream open hole 8*d*) of the slide plate 4 was located immediately below a sliding locus of the inlet (upstream open hole 8*u*) of the upper fixed plate 3, alteration of a sliding gate hardware is minimized. The turning flow evaluation result was GOOD.

Comparative Example C (refer to Table 1 and FIGS. 8 and 9) had a configuration similar to that of Example B of the present invention. However, in Comparative Example C, the turning was not obtained because the difference between $\theta_1$ and $\theta_2$ was 180°. The turning flow evaluation result was BAD.

Comparative Example D (refer to Table 1 and FIGS. 10 and 11) was a normal sliding gate 1 in which all the flow path vertical angles α were 0°. The turning flow evaluation result was BAD.

INDUSTRIAL APPLICABILITY

According to the sliding gate of the present invention, it is possible to solve problems of the prior art, and it is possible to provide a turning flow having sufficient strength in a ladle shroud for injecting molten metal by a compact and simple mechanism without increasing a risk of blockage of a flow path.

BRIEF DESCRIPTION OF THE REFERENCE SYMBOLS

1: sliding gate
2: plate

3: upper fixed plate
4: slide plate
5: lower fixed plate
6: flow path hole
7*u*: upstream surface (upstream-side surface)
7*d*: downstream surface (downstream-side surface)
8*u*: upstream open hole (upstream-side surface open hole)
8*d*: downstream open hole (downstream-side surface open hole)
9*u*: centroid of upstream open hole (centroid of upstream-side surface open hole figure)
9*d*: centroid of downstream open hole (centroid of downstream-side surface open hole figure)
10: flow path axial direction
11: ladle shroud
12: long nozzle
13: immersion nozzle
14: ladle
15: tundish
16: mold
17: flow path
18: streamline
21: molten metal
30: sliding surface
31: flow path axial direction projected on sliding surface
32: vertical downstream direction
33: sliding closing direction
α: flow path vertical angle
θ: flow path horizontal angle

The invention claimed is:

1. A sliding gate which comprises a plurality of plates having a flow path hole through which molten metal passes, at least one of the plurality of plates being a slidable slide plate, and is used for adjusting a flow rate of the molten metal, wherein in the flow path hole in each of the plurality of plates, an upstream-side surface open hole is formed on an upstream-side surface of surfaces of the plate located on an upstream side of the molten metal passing through the flow path hole, and a downstream-side surface open hole is formed on a downstream-side surface of surfaces of the plate located on a downstream side, wherein when a direction from a centroid of a figure of the upstream-side surface open hole toward a centroid of a figure of the downstream-side surface open hole is defined as a flow path axial direction, a flow path vertical angle α between a vertical downstream direction which is a downstream direction perpendicular to sliding surfaces of the plurality of plates and the flow path axial direction is 5° or more and 75° or less, wherein in each of the plurality of plates, a center of gravity of the figure of the upstream-side surface open hole and a center of gravity of the figure of the downstream-side surface open hole are different, and wherein when a direction in which the flow path axial direction is projected on the sliding surface is referred to as a flow path axial direction projected on sliding surface, a sliding direction of the slide plate when the sliding gate is closed is referred to as a sliding closing direction, an angle which is formed between the sliding closing direction and the flow path axial direction projected on sliding surface clockwise when viewed in the vertical downstream direction is referred to as a flow path horizontal angle θ which is within a range of ±180°, the flow path horizontal angles θ being different between the plurality of plates adjacent to each other, the number of the plurality of plates is a total of N, where N is an integer of 2 or more, the flow path horizontal angles θ of the plurality of plates are sequentially set to $\theta_1$, $\theta_2$, . . . $\theta_N$ from the plate on a most upstream side to an Nth plate, and an angle $\Delta\theta_i=\theta_N-\theta_{N+1}$ (n is an integer of 1 or more and up to the number of N−1), the angles $\Delta\theta_i$ are each 10° or more and less than 170°, or all the angles $\Delta\theta_i$ are more than −170° and −10° or less, wherein when the angles $\Delta\theta_n$ is 10° or more and less than 170°, it indicates that the flow path horizontal angle $\theta_N$ is changed counterclockwise from the upstream side to the downstream side, and wherein when the angles $\Delta\theta_n$ is more than −170° and −10° or less, it indicates that the flow path horizontal angle $\theta_N$ is changed clockwise from the upstream side to the downstream side.

2. The sliding gate according to claim 1, wherein the total number of the plurality of plates is two or three, and the number of the slide plates is one.

* * * * *